US010994808B2

(12) United States Patent
Seo

(10) Patent No.: US 10,994,808 B2
(45) Date of Patent: May 4, 2021

(54) VESSEL CARGO HOLD HAVING VOID SPACE

(71) Applicant: Hyundai Heavy Industries Co., Ltd., Ulsan (KR)

(72) Inventor: Young Ho Seo, Ulsan (KR)

(73) Assignee: Hyundai Heavy Industries Co., Ltd., Ulsan (KR)

( * ) Notice: Subject to any disclaimer, the term of this patent is extended or adjusted under 35 U.S.C. 154(b) by 0 days.

(21) Appl. No.: 16/080,195

(22) PCT Filed: Feb. 16, 2017

(86) PCT No.: PCT/KR2017/001691

§ 371 (c)(1),
(2) Date: Aug. 27, 2018

(87) PCT Pub. No.: WO2017/159999

PCT Pub. Date: Sep. 21, 2017

(65) Prior Publication Data

US 2019/0084652 A1 Mar. 21, 2019

(30) Foreign Application Priority Data

Mar. 18, 2016 (KR) ..... 10-2016-0032704

(51) Int. Cl.
*B63B 25/08* (2006.01)
*B63B 11/02* (2006.01)
(Continued)

(52) U.S. Cl.
CPC ..... *B63B 11/02* (2013.01); *B63B 11/04* (2013.01); *B63B 25/08* (2013.01); *B63B 73/43* (2020.01)

(58) Field of Classification Search
CPC ..... B63B 11/00; B63B 11/02; B63B 11/04; B63B 25/08; B63B 2025/08;
(Continued)

(56) References Cited

U.S. PATENT DOCUMENTS 3,938,457 A * 2/1976 Dwyer ..... B63B 1/04 114/61.31
5,189,975 A * 3/1993 Zednik ..... B63B 9/04 114/74 A

FOREIGN PATENT DOCUMENTS

JP 2004-114877 A 4/2004
JP 3919202 B1 5/2007
(Continued)

*Primary Examiner* — Daniel V Venne
(74) *Attorney, Agent, or Firm* — Blank Rome LLP

(57) ABSTRACT

A cargo hold having a plurality of spaces, which are formed by a longitudinal bulkhead and a transverse bulkhead intersecting each other and store crude oil, comprises a void space located at least one corner among corners formed by intersection of the longitudinal bulkhead and the transverse bulkhead, wherein the void space is formed of a void space structure having one side end and the other side end sealed by and fixed to the longitudinal bulkhead and the transverse bulkhead, respectively, thereby forming an empty space inside the bulkheads. The vessel cargo hold prevents a danger, such as fire and explosion, which may occur during the maintenance or repair of the vessel cargo hold for storing crude oil, and decreases work or the like required for the maintenance or repair of the cargo hold.

3 Claims, 6 Drawing Sheets

(51) Int. Cl.
*B63B 11/04* (2006.01)
*B63B 73/43* (2020.01)

(58) Field of Classification Search
CPC ..... B63B 2025/085; B63B 2701/10; B63B 2701/18; B63B 2221/00; B63B 2221/02
USPC ..... 114/74 R, 74 A, 77 R, 77 A, 78
See application file for complete search history.

(56) References Cited

FOREIGN PATENT DOCUMENTS

| | | | |
|---|---|---|---|
| JP | 2014-28530 | A | 2/2014 |
| KR | 20-0388914 | Y1 | 6/2005 |
| KR | 10-2009-0027070 | A | 3/2009 |
| KR | 20-2014-0000872 | U | 2/2014 |
| KR | 10-2016-0008876 | A | 1/2016 |

* cited by examiner

VESSEL CARGO HOLD HAVING VOID SPACE

TECHNICAL FIELD

This disclosure relates to a vessel cargo hold, and more particularly, to a vessel cargo hold capable of preventing dangers such as fires and explosions, which may occur during the maintenance or repair of the vessel cargo hold for storing crude oil, and decreasing work or the like required for the maintenance or repair of the vessel cargo hold.

BACKGROUND ART

Floating production storage offloading (FPSO) is a special ship equipped with an offshore plant suitable for the development of small-scale deep-sea oil fields because it is capable of mining, storing and unloading crude oil on the sea and moving freely.

The FPSO refines the crude oil extracted from an offshore plant or drillship and stores the crude oil in a shuttle tanker or other transporting place. The FPSO includes a hull that is a lower ship structure for storing refined crude oil and a top side that is an upper equipment for producing and processing the crude oil.

Hereinafter, the special ships such as FPSO and FPU, which store refined crude oil, are collectively referred to as 'vessels'.

FIG. 1 is a planar sectional view showing a cargo hold according to the conventional art, and FIG. 2 is a planar sectional view showing that cargo is unloaded from the cargo hold depicted in FIG. 1 in order to maintain and repair corners of the cargo hold.

As shown in FIG. 1, a vessel 1 refines mined crude oil at the top side and then stores the refined crude oil in a cargo hold 10 constructed in the hull.

In order to store the purified crude oil to be classified depending on types, the cargo hold 10 is configured such that a longitudinal bulkhead 21 located in a longitudinal direction of the vessel 1 and a transverse bulkhead 22 located in a transverse direction of the vessel 1 intersect each other, and the intersections are welded for sealing.

The cargo hold 10 configured as above needs to be checked for welding conditions at the intersections of the longitudinal bulkhead 21 and the transverse bulkhead 22, and if the repair is necessary, the crude oil stored in the cargo hold 10 should be emptied before repairing.

More specifically, as shown in FIG. 2, four corners 11C, 12C, 13C, 14C are formed at the intersections of the longitudinal bulkhead 21 and the transverse bulkhead 22. If one corner among the four corners 11C, 12C, 13C, 14C is repaired, the crude oil in all of the four corners 11C, 12C, 13C, 14C is emptied out in order to prevent fire and explosion which may occur during the repair process since flame spatters to the oil stored in the longitudinal bulkhead 21 or transverse bulkhead 22 at an opposite side.

As an example, when the first corner 11C depicted in FIG. 2 is repaired, the first cargo hold 10 including the first corner 11C should be emptied so that a worker may work at the first corner 11C. In addition, in order to prevent any possible fire and explosion during welding, all of the second cargo hold 10 at the second corner 12C, the third cargo hold 10 at the third corner 13C and the fourth cargo hold 10 at the fourth corner 14C should also be emptied.

Moreover, if the crude oil stored in all of the four neighboring cargo holds 11, 12, 13, 14 including the corners 11C, 12C, 13C, 14C is emptied, the storage space is insufficient, which results in a reduced yield to cause a loss. In addition since the cargo quantity at one side of the vessel is seriously reduced, the vessel is inclined. At this time, the inclination and depth of the vessel is controlled by the ballast water for compensation, but the amount of the ballast water necessary for the adjustment is increased as the amount of the reduced cargo quantity is increased, thereby deteriorating the work efficiency.

Technical Problem

This disclosure is directed to providing a vessel cargo hold configured to increase efficiency during a repair work by mounting a structure to form an empty space by wrapping the intersections of a longitudinal bulkhead and a transverse bulkhead that partition the vessel cargo hold, thereby reducing the number of cargo holds that should be emptied when repair such as welding is required.

Also, this disclosure is directed to providing a vessel cargo hold configured to reinforce the longitudinal bulkhead and the transverse bulkhead by installing a structure to the intersections of the longitudinal bulkhead and the transverse bulkhead.

Technical Solution

In one general aspect, there is provided a vessel cargo hold having a plurality of spaces, which are formed by a longitudinal bulkhead and a transverse bulkhead intersecting each other for storing crude oil, the vessel cargo hold comprising a void space located to at least one corner of corners formed by intersection of the longitudinal bulkhead and the transverse bulkhead, wherein the void space has a square tubular shape formed by a void space structure having one side end and the other side end sealed by and fixed to the longitudinal bulkhead and the transverse bulkhead, respectively, thereby forming an empty space therein.

According to an embodiment, the void space may fixed to one or two corners among four corners formed by intersection of the longitudinal bulkhead and the transverse bulkhead.

According to an embodiment, a top of the void space structure may be fixed to a top deck and a bottom of the void space structure may be fixed to a bottom deck to prevent fluid stored in the cargo hold from flowing into the void space.

According to an embodiment, one side end of void space structure may be welded in contact with the transverse bulkhead, the other side end of the void space structure may be welded in contact with the longitudinal bulkhead, a top of the void space structure may be welded and fixed to a top deck, and a bottom of the void space structure may be welded and fixed to a bottom deck.

According to an embodiment, where the void space structures are mounted to both sides of the longitudinal bulkhead or the transverse bulkhead, a passage may be formed in the longitudinal bulkhead or the transverse bulkhead between the respective void spaces.

Advantages

As described above, in the vessel cargo hold having a void space according to an embodiment of the present disclosure, providing a void space surrounding an intersecting vertical line at the intersection of a longitudinal bulkhead and a transverse bulkhead, which form a cargo hold makes it is possible to safely perform the repair work in a state of emptying only two or three cargo holds, compared to a conventional art where four neighboring cargo holds are emptied to repair the intersecting vertical line. Accordingly, the loss caused by the reduction in production amount is decreased and the working efficiency is improved.

Also, as the number of cargo holds to be emptied is reduced, the flow rate of the ballast water to control the inclination and depth of the vessel may be reduced, thereby increasing the working efficiency.

In addition, the vessel cargo hold according to an embodiment of the present disclosure may improve the rigidity of the longitudinal bulkhead and the transverse bulkhead of the cargo hold by installing a void space structure, thereby reducing the amount of reinforcing members installed at the existing longitudinal bulkhead and transverse bulkhead.

DETAILED DESCRIPTION OF THE PREFERRED EMBODIMENTS

Hereinafter, a vessel cargo hold having a void space according to the present disclosure will be described in detail with reference to the accompanying drawings.

First Embodiment

Figure 1:
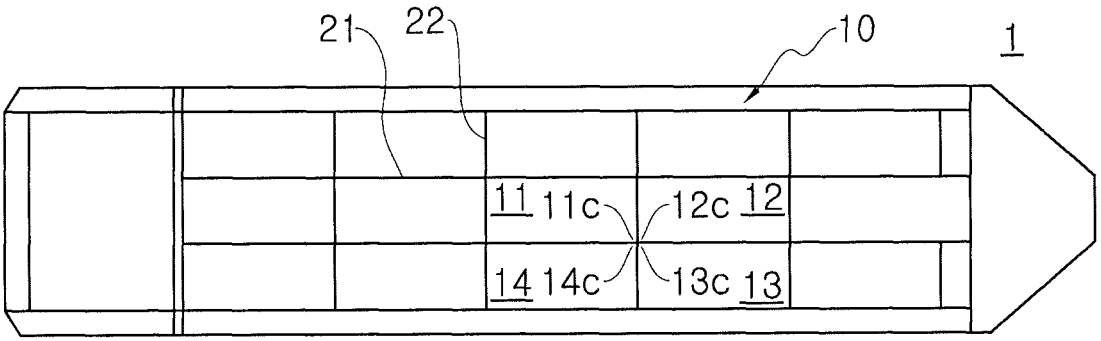
FIG. 1 is a planar sectional view showing a cargo hold according to the conventional art.
Figure 2:
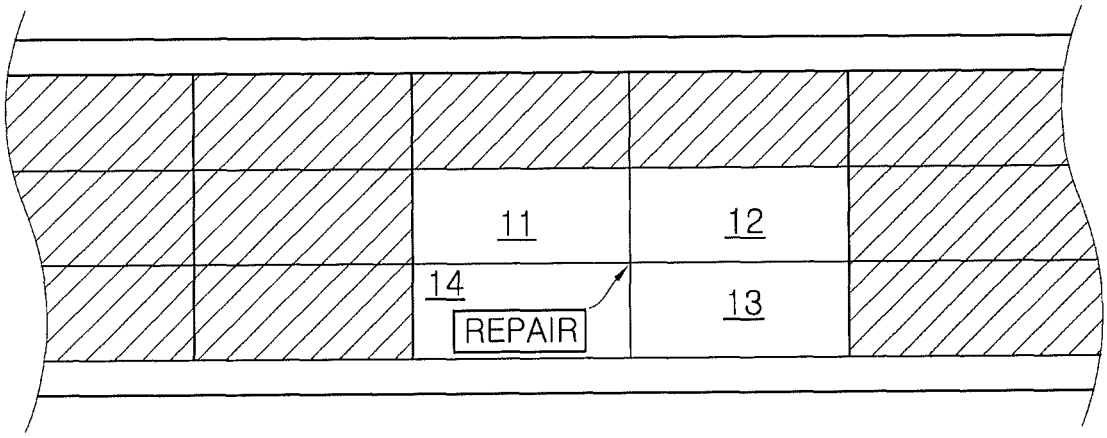
FIG. 2 is a planar sectional view showing that cargo is unloaded from the cargo hold depicted in FIG. 1 in order to maintain and repair corners of the cargo hold.
Figure 3A:
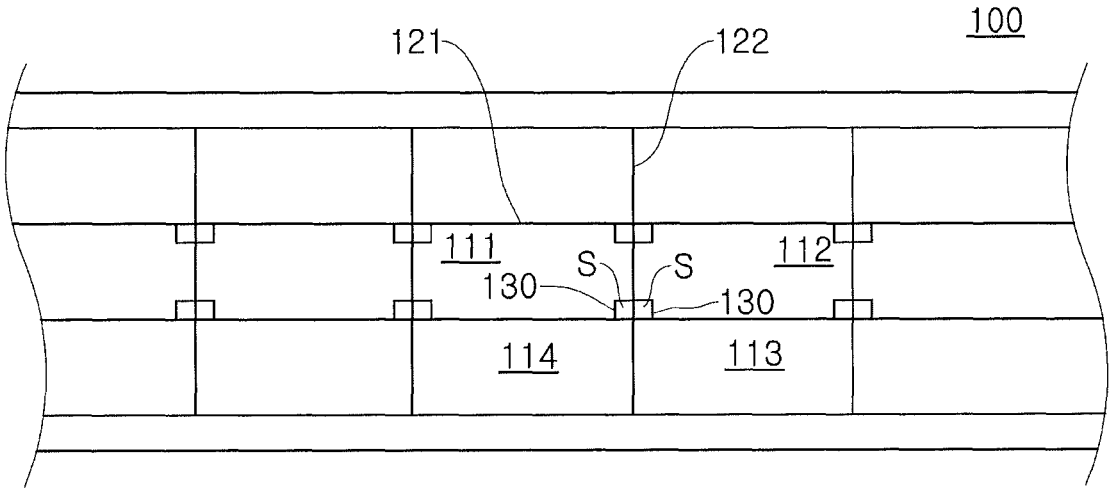
FIGS. 3A and 3B are planar sectional views showing a vessel cargo hold according to the first embodiment of the present disclosure.
Figure 3B:
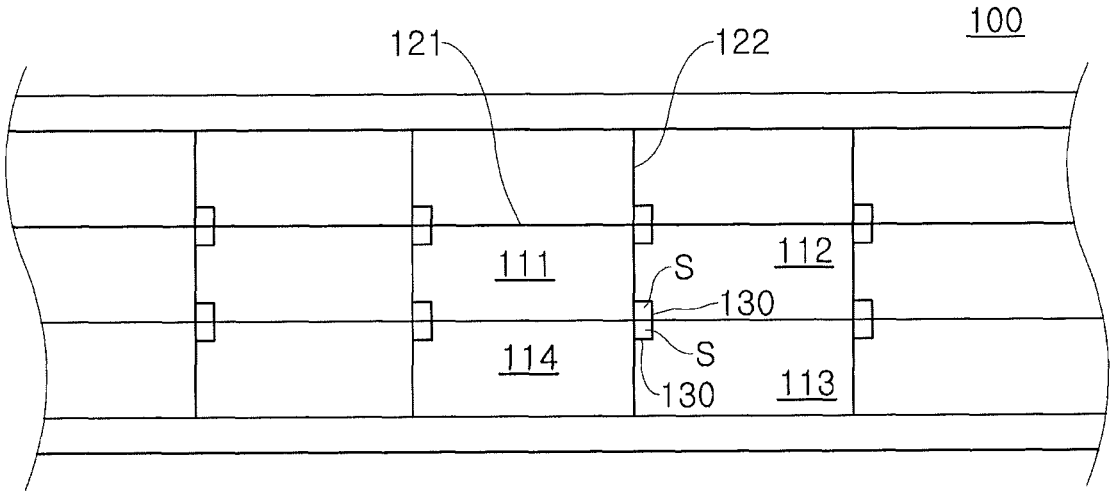
Figure 4A:
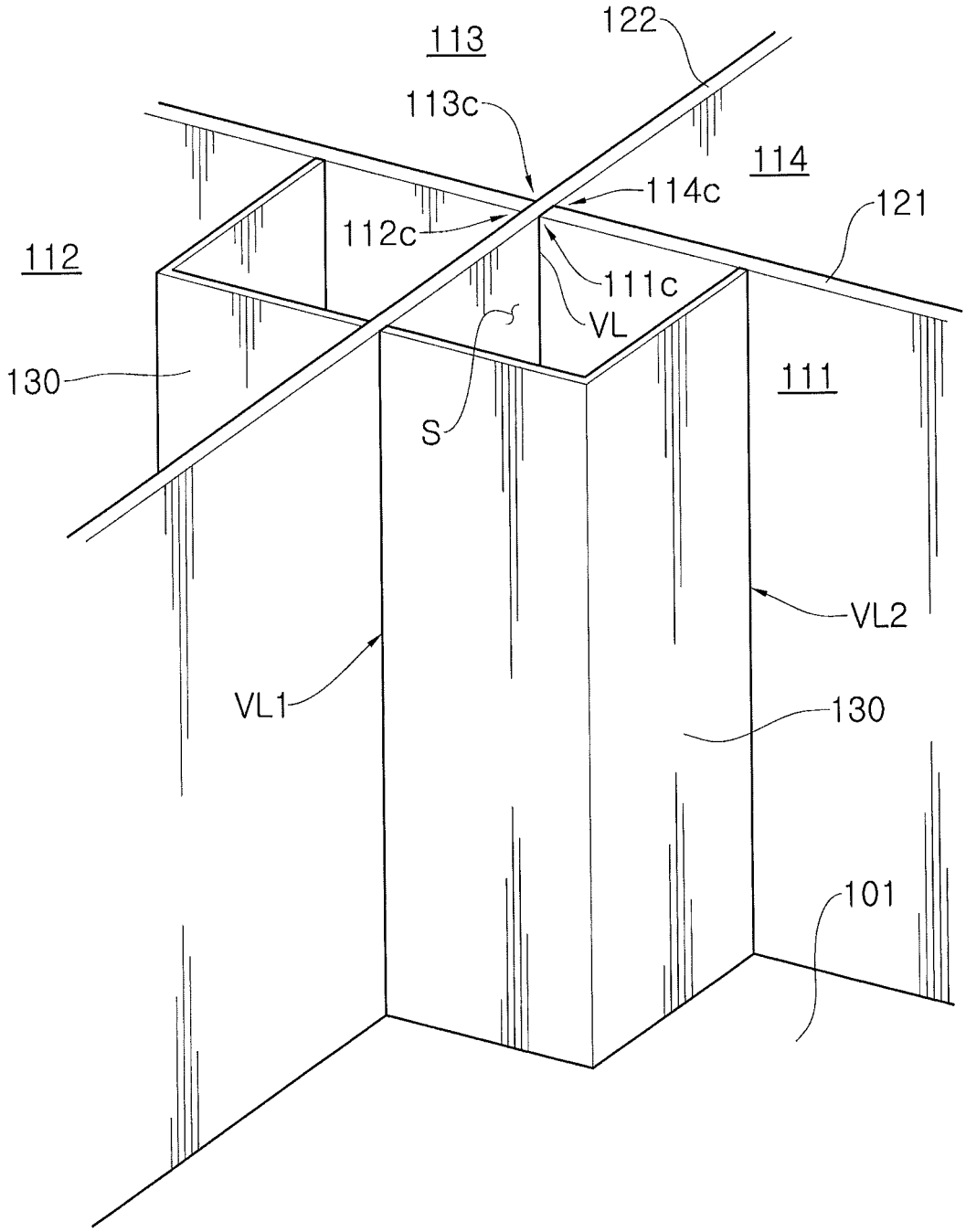
FIG. 4A is a diagram showing that a void space structure is mounted to the vessel cargo hold.
Figure 4B:
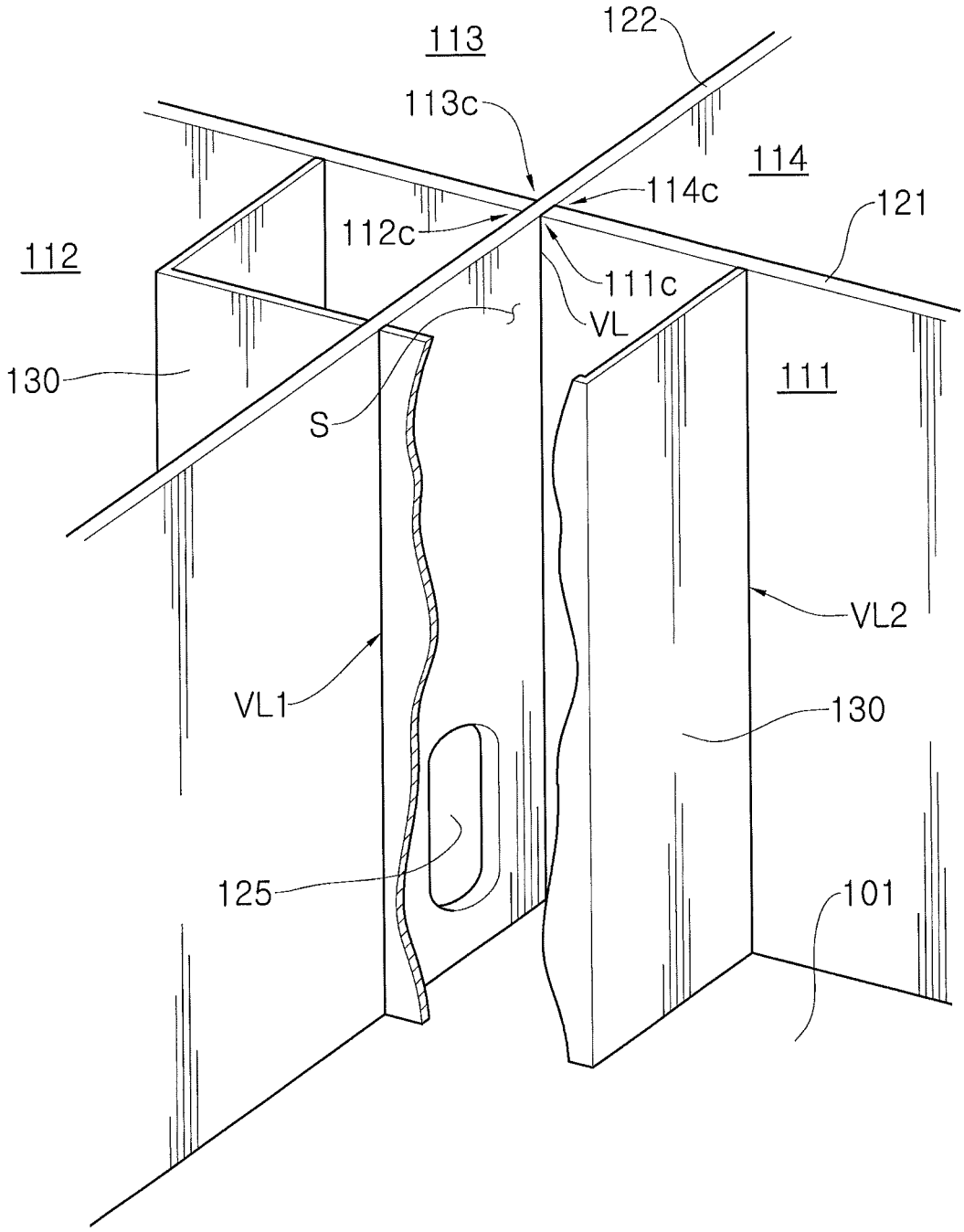
FIG. 4B is a diagram showing a passage formed at a transverse bulkhead to correspond to an inner space of the void space structure.
Figure 5A:
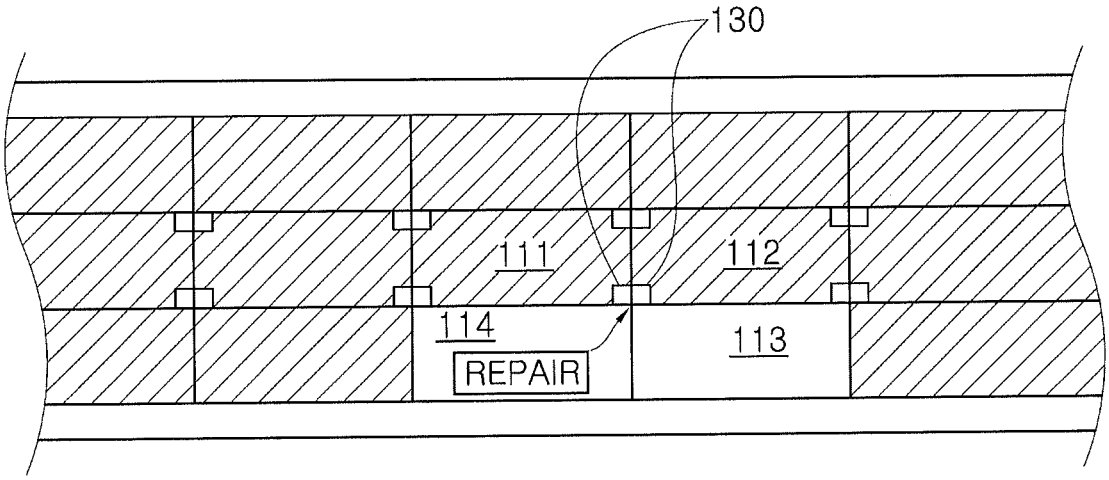
FIGS. 5A and 5B are planar sectional views showing the cargo hold that is empty for repairing the first cargo hold in FIGS. 3A and 3B, respectively.
Figure 5B:
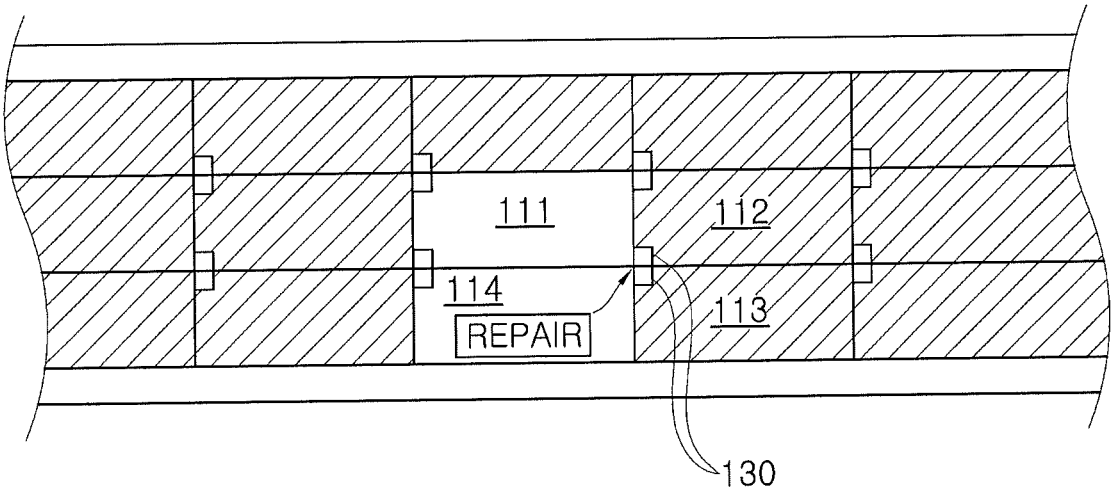

In the drawings, FIGS. 3A and 3B are planar sectional views showing a vessel cargo hold according to the first embodiment of the present disclosure. FIG. 4A is a diagram showing that a void space structure is mounted to the vessel cargo hold, and FIG. 4B is a diagram showing a passage formed at a transverse bulkhead to correspond to an inner space of the void space structure. FIGS. 5A and 5B are planar sectional views showing the cargo hold that is empty for repairing the first cargo hold in FIGS. 3A and 3B, respectively.

As shown in FIGS. 3A and 3B, a plurality of cargo holds 111, 112, 113, 114 partitioned by intersecting a longitudinal bulkhead 121 and a transverse bulkhead 122 with each other at a right angle are formed inside a hull of a vessel 100, and refined crude oil is stored in each of the cargo holds 111, 112, 113, 114.

Meanwhile, as the longitudinal bulkhead 121 and the transverse bulkhead 122 intersect each other at a right angle, four cargo holds 111, 112, 113, 114 are located around the intersection point.

Hereinafter, the four cargo holds 111, 112, 113, 114 will be called a first cargo hold 111, a second cargo hold 112, a third cargo hold 113 and a fourth cargo hold 114 in a clockwise direction about the intersection point (see FIGS. 3 and 4). In addition, four corners formed at the intersection point are called a first corner 111C of the first cargo hold 111, a second corner 112C of the second cargo hold 112, a third corner 113C of the third cargo hold 113, and a fourth corner 114C of the fourth cargo hold 114.

In the cargo holds 111, 112, 113, 114 configured as above, at any one corner and another corner adjacent thereto, a void space structure 130 having two rectangular and perpendicular side panels is welded and fixed to the longitudinal bulkhead 121 and the transverse bulkhead 122 along an intersecting vertical line VL of the intersection point, creating a void space having a square tubular shape.

In detail, in the cargo hold to which the void space structure 130 is mounted, as shown in FIG. 4A, based on any one bulkhead made of steel sheet between the longitudinal bulkhead 121 and the transverse bulkhead 122, the void space structure 130 is mounted to both sides of the bulkhead. In other words, both side ends of the void space structure 130 are welded in contact with the longitudinal bulkhead 121 and the transverse bulkhead 122, and a top and a bottom of the void space structure 130 are welded in contact with a top deck (not shown) and a bottom deck 101. In the figures, FIG. 3A shows a state where the void space structure 130 is fixed to the first corner 111C and the second corner 112C, and FIG. 3B shows a state where the void space structure 130 is fixed to the second corner 112C and the third corner 113C.

In the cargo holds 111, 112, 113, 114 configured as above, when it is intended to repair an intersection point of any one cargo hold to which the void space structure 130 is not fixed, the intersection point may be repaired after emptying crude oil out of the cargo hold to be repaired and another cargo hold among three cargo holds adjacent thereto to which the void space structure 130 is not fixed.

In detail, as shown in FIG. 5A, when it is intended to repair the fourth corner 114C of the fourth cargo hold 114 to which the void space structure 130 is not fixed, the fourth corner 114C of the fourth cargo hold 114 is repaired in a state of emptying the crude oil out of the third cargo hold 113 and the fourth cargo hold 114.

When a worker repairs the fourth corner 114C of the fourth cargo hold 114, at the first cargo hold 111 and the second cargo hold 112 in which the crude oil is stored, the void space structure 130 is mounted to the first corner 111C and the second corner 112C, respectively, thereby preventing dangers such as fire and explosion during repair in advance.

Meanwhile, as shown in FIG. 5B, if it is intended to repair the fourth corner 114C of the fourth cargo hold 114 to which the void space structure 130 is not fixed, the fourth corner 114C of the fourth cargo hold 114 is repaired in a state where the crude oil of the fourth cargo hold 114 and the first cargo hold 111 is emptied.

When the worker repairs the fourth corner 114C of the fourth cargo hold 114, at the second cargo hold 112 and the third cargo hold 113 in which the crude oil is stored, the void space structure 130 is mounted to the second corner 112C and the third corner 113C, respectively, thereby preventing dangers such as fire and explosion during repair in advance.

In addition, as shown in FIG. 4A, when the cargo hold 111 to which the void space structure 130 is mounted is repaired, a welded vertical line VL1 formed by welding the void space structure 130 and the transverse bulkhead 122 in contact or a welded vertical line VL2 formed by welding the void space structure 130 and the longitudinal bulkhead 121 in contact is repaired, and thus it is possible to repair the cargo hold 111 in a state where the cargo hold to be repaired, namely only one cargo hold 111 at which the void space structure 130 is installed, is emptied.

Specifically, in the cargo hold structure shown in FIG. 4A, when it is intended to repair the vertical line VL1 welded with the transverse bulkhead 122 or the vertical line VL2 welded with the longitudinal bulkhead 121 among both side ends of the void space structure 130 mounted to the first cargo hold 111, it is repaired in a state where the crude oil of the first cargo hold 111 is emptied. This is because there is no risk of fire or explosion even if the vertical lines VL1, VL2 are welded since the ends of the void space structure 130 in the width direction are not welded to the corners 111C, 112C, 113C, 114C but welded to a middle of the width of the longitudinal bulkhead 121 or the transverse bulkhead 122.

Since the empty space S is formed at two corners among four corners 111C, 112C, 113C, 114C by the void space structure 130 as described above, in the vessel cargo hold according to the present disclosure, the repair work may be performed in a state one or two cargo holds are emptied, different from the conventional case where the crude oil is emptied from four cargo holds.

Meanwhile, as shown in FIG. 4B, as the void space structure 130 is mounted, void spaces S are formed at both sides based on the transverse bulkhead 122. The void space S is maintained as an empty space. If necessary, a worker performs the repair work inside the void space S. Here, a passage 125 through which the worker may move may be formed at a bottom of the transverse bulkhead 122 to correspond to the void space S, and in this case, a facility required for the worker to pass may be installed in only one void space S.

In addition, as the void space structure 130 is welded in contact with the longitudinal bulkhead 121 and the transverse bulkhead 122, the rigidity of the longitudinal bulkhead 121 and the transverse bulkhead 122 may be reinforced. Thus, it is advantageous that the amount of a reinforcing member conventionally fixed to give the same rigidity may be reduced.

Meanwhile, it has been described in the first embodiment that two void space structures 130 are mounted to both sides of the longitudinal bulkhead 121 or the transverse bulkhead 122. However, the effect realized by the void space structures described above may be obtained in the same manner even though void space structures are mounted to two diagonal corners among the four corners, namely to the first corner 111C and the third corner 113C or to the second corner 112C and the fourth corner 114C.

Second Embodiment

It has been described in the first embodiment that the repair work may be performed in a state where two cargo holds are emptied by mounting the void space structures to two corners among four corners.

Meanwhile, in the following, a second embodiment where a void space structure is mounted to one corner among four corners is described. Any component of the second embodiment, which is similar to that of the first embodiment and thus described already, will not be described in detail.

Figure 6A:
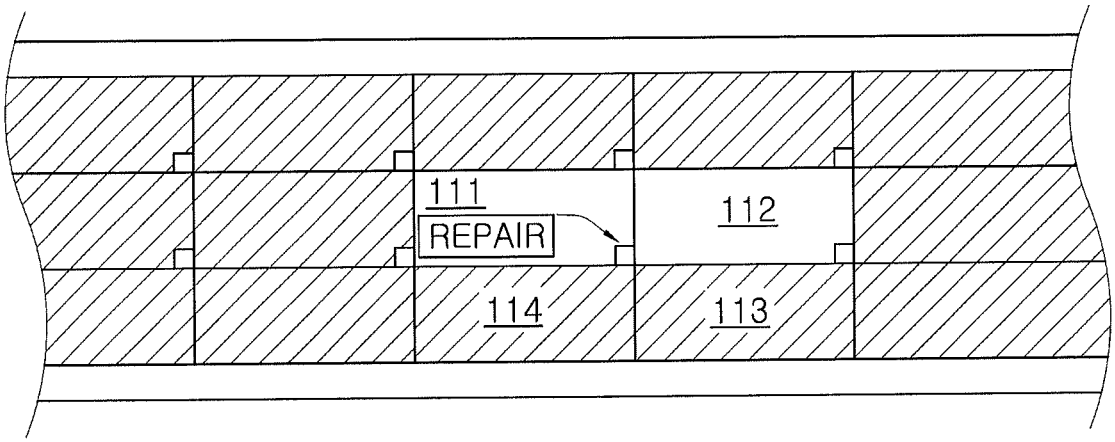
FIGS. 6A to 6C are planar sectional views showing the void space structure mounted to the vessel cargo hold according to the second embodiment of the present disclosure and the cargo hold that is empty for repairing the cargo hold.
Figure 6B:
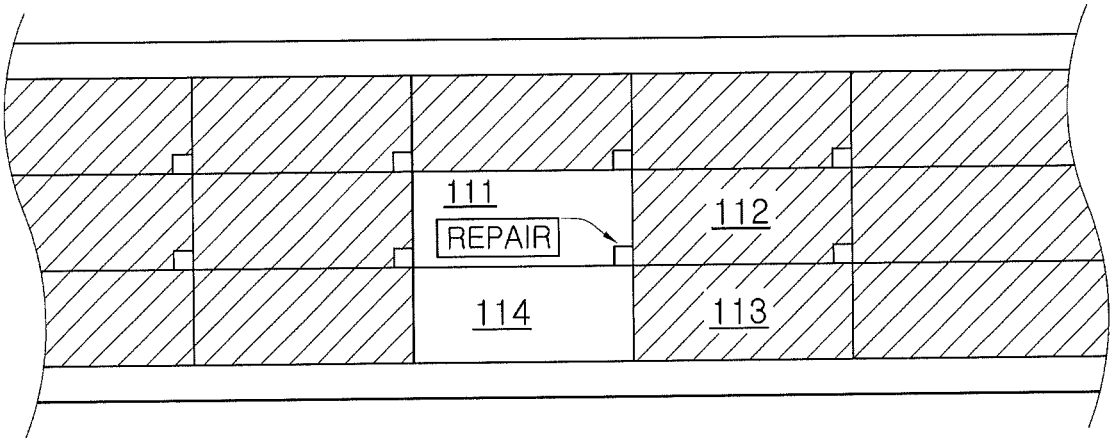
Figure 6C:
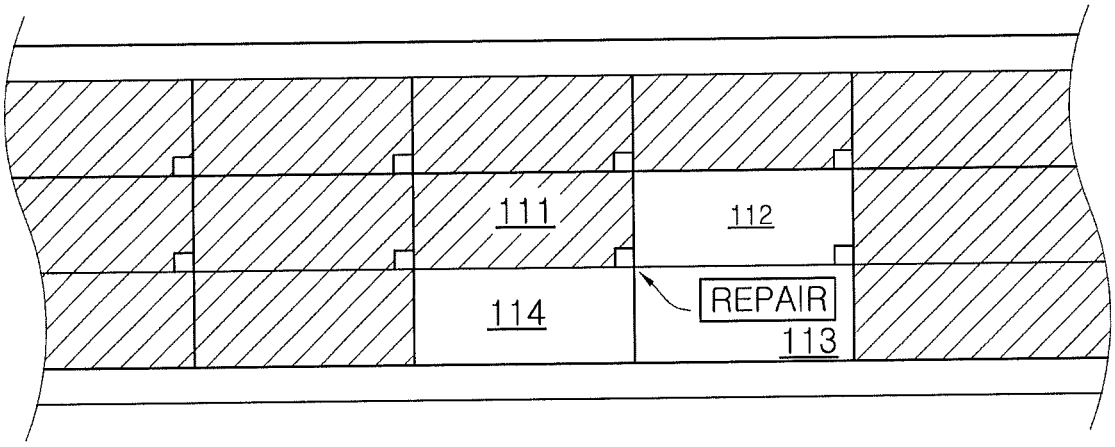

In the drawings, FIGS. 6A to 6C are planar sectional views showing the void space structure mounted to the vessel cargo hold according to the second embodiment of the present disclosure and the cargo hold that is empty for repairing the cargo hold.

As shown in FIG. 6A, when the void space structure 130 is mounted only to the first corner 111C among the first corner 111C to the fourth corner 114C, if it is intended to perform a repair work between the one end of the void space structure 130 and the transverse bulkhead 122 adjacent to one end of the void space structure 130, it is possible to perform the repair work in a state where the crude oil of the first cargo hold 111 and the second cargo hold 112 is emptied.

In addition, as shown in FIG. 6B, if it is intended to perform a repair work between the other end of the void space structure 130 and the longitudinal bulkhead 121 adjacent to the other end of the void space structure 130, it is possible to perform the repair work in a state where the crude oil of the first cargo hold 111 and the fourth cargo hold 114 is emptied.

Meanwhile, as shown in, FIG. 6C, if it is intended to repair the third corner 113C of the third cargo hold 113 in a state where the void space structure 130 is not mounted to the third cargo hold 113, it is possible to repair the third corner 113C, namely along the intersecting vertical line VL at which the longitudinal bulkhead 121 and the transverse bulkhead 122 intersect, in a state where the crude oil of the second cargo hold 112, the third cargo hold 113 and the fourth cargo hold 114 is emptied.

Even though the void space structure 130 is mounted to one corner among four corners 111C, 112C, 113C, 114C, the repair work may be performed in a state where two or three cargo holds are emptied, thereby ensuring excellent work efficiency in comparison to the conventional art where four cargo holds should be emptied.

In the former embodiments, a level switch (not shown) may be mounted in the void space S formed by mounting the void space structure 130 so as to detect whether crude oil is introduced into the void space S.

What is claimed is:

1. A vessel cargo hold having a plurality of spaces, which are formed by a longitudinal bulkhead and a transverse bulkhead intersecting each other, the vessel cargo hold comprising a void space located in at least one corner of corners formed by an intersection of the longitudinal bulkhead and the transverse bulkhead, wherein the void space has a square tubular shape formed by a void space structure having two rectangular and perpendicular side panels, a first side end and a second side end of the void space structure being sealed by and fixed to the longitudinal bulkhead and the transverse bulkhead, respectively, the void space structure further having bottom and top ends sealed by and fixed to, respectively, a bottom deck and a top deck of the vessel cargo hold, the void space structure thereby wrapping and surrounding the at least one corner of corners at the intersection and sealing the void space horizontally between the first and second side ends and the at least one corner of corners at the intersection, and sealing the void space vertically between the top deck and bottom deck, to prevent fluid stored in the cargo hold from flowing into the void space, wherein the void spaces structures are mounted to each side of the longitudinal bulkhead or the transverse bulkhead, and further comprising a passage formed in the longitudinal bulkhead or the transverse bulkhead between the void spaces on each side of the longitudinal bulkhead or the transverse bulkhead.

2. The vessel cargo hold according to claim 1, wherein the void space structure is fixed to one or two corners among four corners of the space formed by intersection of the longitudinal bulkhead and the transverse bulkhead.

3. The vessel cargo hold according to claim 2, wherein the first side end of void space structure is welded in contact with the transverse bulkhead, and the second side end of the void space structure is welded in contact with the longitudinal bulkhead.

* * * * *